US007736165B2

(12) United States Patent
Bukovnik et al.

(10) Patent No.: US 7,736,165 B2
(45) Date of Patent: Jun. 15, 2010

(54) ELECTRICAL CONNECTOR ASSEMBLIES AND METHODS FOR FORMING AND USING THE SAME

(75) Inventors: Rudolf Robert Bukovnik, Chapel Hill, NC (US); George W. Pullium, III, Garner, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 12/171,498

(22) Filed: Jul. 11, 2008

(65) Prior Publication Data

US 2009/0023321 A1 Jan. 22, 2009

Related U.S. Application Data

(60) Provisional application No. 60/959,753, filed on Jul. 16, 2007.

(51) Int. Cl.
*H01R 13/52* (2006.01)

(52) U.S. Cl. ..... 439/276; 439/936

(58) Field of Classification Search ..... 439/276, 439/936, 475, 521, 810, 814; 174/76
See application file for complete search history.

(56) References Cited

U.S. PATENT DOCUMENTS

| | | | | |
|---|---|---|---|---|
| 2,311,758 | A | 2/1943 | Johansson | |
| 2,932,685 | A | 4/1960 | Raila et al. | 174/84 C |
| 3,020,260 | A | 2/1962 | Nelson | |
| 3,168,613 | A | 2/1965 | Palmer | 174/65 R |
| 3,740,692 | A | 6/1973 | Filhaber | 439/523 |
| 4,214,806 | A * | 7/1980 | Kraft | 439/620.21 |
| 4,369,284 | A | 1/1983 | Chen | |
| 4,425,017 | A | 1/1984 | Chan | |

(Continued)

FOREIGN PATENT DOCUMENTS

| | | |
|---|---|---|
| DE | 34 28 258 A1 | 2/1986 |

(Continued)

OTHER PUBLICATIONS

Notification of Transmittal of the International Search Report and the Written Opinion of the International Searching Authority, or the Declaration, corresponding to PCT Application No. PCT/US2008/008575, Mailed: Feb. 25, 2009.

(Continued)

*Primary Examiner*—Michael C Zarroli
*Assistant Examiner*—Vladimir Imas
(74) *Attorney, Agent, or Firm*—Myers Bigel Sibley & Sajovec, PA

(57) ABSTRACT

An electrical connector for use with a conductor includes a housing, a conductor member and a flowable sealant. The housing defines a port. The port includes: an entrance opening; an exit opening; and a conductor passage extending between and communicating with the entrance and exit openings, the conductor passage being adapted to receive the conductor therethrough. The conductor member is disposed in the housing. The sealant is disposed in the conductor passage. The sealant is adapted for insertion of the conductor therethrough and to the conductor member such that the sealant provides a seal about the inserted conductor. The sealant is positively pre-pressurized prior to insertion of the conductor into the sealant.

20 Claims, 8 Drawing Sheets

U.S. PATENT DOCUMENTS

| | | | | |
|---|---|---|---|---|
| 4,595,635 | A | 6/1986 | Dubrow et al. | |
| 4,600,261 | A | 7/1986 | Debbaut | |
| 4,634,207 | A | 1/1987 | Debbaut | |
| 4,662,692 | A | 5/1987 | Uken et al. | 439/426 |
| 4,680,233 | A | 7/1987 | Camin et al. | |
| 4,701,574 | A | 10/1987 | Shimirak et al. | |
| 4,716,183 | A | 12/1987 | Gamarra et al. | |
| 4,721,832 | A | 1/1988 | Toy | |
| 4,751,350 | A | 6/1988 | Eaton | 174/87 |
| 4,777,063 | A | 10/1988 | Dubrow et al. | |
| 4,795,857 | A | 1/1989 | McInnis | 439/521 |
| 4,846,721 | A | 7/1989 | Debruycker et al. | 439/411 |
| 4,852,646 | A | 8/1989 | Dittmer et al. | |
| 4,880,676 | A | 11/1989 | Puigcerver et al. | |
| 4,888,070 | A | 12/1989 | Clark et al. | |
| 4,942,270 | A | 7/1990 | Gamarra | |
| 4,963,700 | A | 10/1990 | Olsen et al. | |
| 5,023,402 | A | 6/1991 | King, Jr. et al. | |
| 5,079,300 | A | 1/1992 | Dubrow et al. | |
| 5,099,088 | A | 3/1992 | Usami et al. | |
| 5,140,476 | A | 8/1992 | Kim | |
| 5,149,281 | A | 9/1992 | Hills et al. | 439/521 |
| 5,177,143 | A | 1/1993 | Chang et al. | |
| 5,357,057 | A | 10/1994 | Debbaut | |
| 5,364,283 | A | 11/1994 | Katoh et al. | |
| 5,529,508 | A | 6/1996 | Chiotis et al. | |
| 5,561,269 | A | 10/1996 | Robertson et al. | |
| 5,588,856 | A | 12/1996 | Collins et al. | |
| 5,741,156 | A | 4/1998 | Wilson | 439/521 |
| 5,824,954 | A | 10/1998 | Biche et al. | |
| 5,828,005 | A | 10/1998 | Huynh-Ba et al. | |
| 5,848,913 | A * | 12/1998 | Ashcraft | 439/521 |
| 5,962,811 | A | 10/1999 | Rodrigues et al. | |
| 6,025,559 | A | 2/2000 | Simmons | |
| RE37,340 | E | 8/2001 | King, Jr. | 174/87 |
| 6,309,257 | B1 | 10/2001 | Huang | 439/731 |
| 6,730,847 | B1 | 5/2004 | Fitzgerald et al. | |
| 6,848,949 | B2 | 2/2005 | Mullaney et al. | 439/676 |
| 6,854,996 | B2 * | 2/2005 | Yaworski et al. | 439/276 |
| 6,997,759 | B1 * | 2/2006 | Zahnen et al. | 439/798 |
| 7,037,128 | B2 * | 5/2006 | Yaworski et al. | 439/276 |
| 7,056,151 | B2 | 6/2006 | Cawood et al. | |
| 7,160,146 | B2 | 1/2007 | Cawood et al. | |
| 7,201,596 | B1 * | 4/2007 | Bukovnik et al. | 439/276 |
| 2002/0102874 | A1 | 8/2002 | Hobson et al. | |
| 2004/0121639 | A1 * | 6/2004 | Yaworski et al. | 439/276 |
| 2004/0157488 | A1 | 8/2004 | Yaworski et al. | |

FOREIGN PATENT DOCUMENTS

| | | | |
|---|---|---|---|
| DE | 90 04 669 | U1 | 6/1990 |
| EP | 0 108 518 | B1 | 5/1984 |
| EP | 0 203 737 | A2 | 12/1986 |
| EP | 0 328 386 | A2 | 8/1989 |
| EP | 0 948 091 | A | 10/1999 |
| EP | 1 001 495 | A | 5/2000 |
| WO | WO 88/00603 | A2 | 1/1988 |
| WO | WO 90/05401 | A1 | 5/1990 |
| WO | WO 95/15600 | A1 | 6/1995 |
| WO | WO 95/24756 | A1 | 9/1995 |
| WO | WO 96/23007 | A1 | 8/1996 |
| WO | WO 97/42693 | A1 | 11/1997 |

OTHER PUBLICATIONS

Homac Mfg. Company, Fact Sheet, "Flood-Seal"® Rubberized Aluminum Bar, p. 34.

Connector Mfg. Company, Fact Sheet, Submersible Secondary Connectors, Jun. 2001, p. B-1.

* cited by examiner

ELECTRICAL CONNECTOR ASSEMBLIES AND METHODS FOR FORMING AND USING THE SAME

RELATED APPLICATION(S)

This application claims the benefit of U.S. Provisional Patent Application No. 60/959,753, filed Jul. 16, 2007, the disclosure of which is incorporated herein by reference.

FIELD OF THE INVENTION

The present invention relates to electrical connectors and methods for using the same and, more particularly, to environmentally protected electrical connectors and methods for forming environmentally protected connections.

BACKGROUND OF THE INVENTION

Connectors such as multi-tap or busbar connectors are commonly used to distribute electrical power, for example, to multiple residential or commercial structures from a common power supply feed. Busbar connectors typically include a conductor member formed of copper or aluminum housed in a polymeric cover. The conductor member includes a plurality of cable bores. The cover includes a plurality of ports, each adapted to receive a respective cable and to direct the cable into a respective one of the cable bores. A set screw is associated with each cable bore for securing the cables in the respective bores and, thereby, in electrical contact with the conductor member.

The busbar assemblies as described above can be used to electrically connect two or more cables. For example, a feed cable may be secured to the busbar connector through one of the ports and one or more branch or tap circuit cables may be connected to the busbar connector through the other ports to distribute power from the feed cable. Busbar connectors of this type provide significant convenience in that cables can be added and removed from the connection as needed.

Power distribution connections as discussed above are typically housed in an above-ground cabinet or a below-grade box. The several cables are usually fed up through the ground and the connection (including the busbar connector) may remain unattached to the cabinet or box (i.e., floating within the cabinet). The connections may be subjected to moisture, and may even become submerged in water. If the conductor member and the conductors are left exposed, water and environmental contaminants may cause corrosion thereon. Moreover, the conductor member is often formed of aluminum, so that water may cause oxidation of the conductor member. Such oxidation may be significantly accelerated by the relatively high voltages employed (typically 120 volts to 1000 volts).

In order to reduce or eliminate exposure of the conductor member and the conductor portions of the cables to water, some known busbar designs include elastomeric boots or caps. These caps or boots may be difficult or inconvenient to install properly, particularly in the field, and may not provide reliable seals. U.S. Pat. No. 6,854,996, U.S. Pat. No. 7,037,128, U.S. Pat. No. 7,201,596, and U.S. Pat. No. 7,037,128 disclose sealant-filled (e.g., gel-filled) multi-tap busbars.

SUMMARY OF THE INVENTION

According to embodiments of the present invention, an electrical connector for use with a conductor includes a housing, a conductor member and a flowable sealant. The housing defines a port. The port includes: an entrance opening; an exit opening; and a conductor passage extending between and communicating with the entrance and exit openings, the conductor passage being adapted to receive the conductor therethrough. The conductor member is disposed in the housing. The sealant is disposed in the conductor passage. The sealant is adapted for insertion of the conductor therethrough and to the conductor member such that the sealant provides a seal about the inserted conductor. The sealant is positively pre-pressurized prior to insertion of the conductor into the sealant.

According to some embodiments, the sealant is positively pre-pressurized such that an internal pressure of the sealant in the conductor passage is at least 0.5 PSI.

According to some embodiments, the sealant is a gel. The gel may be pre-elastically elongated prior to insertion of the conductor into the gel. In some embodiments, the gel is pre-elastically elongated by at least 5% prior to insertion of the conductor into the gel.

According to some embodiments, the electrical connector includes a compression member disposed in the conductor passage and the positively pre-pressurized sealant applies a load against the compression member prior to insertion of the conductor into the sealant. The compression member may ring-shaped and define a compression member passage, with the electrical connector being configured such that the conductor extends through the compression member passage to engage the conductor member. In some embodiments, the housing includes a ledge locating the compression member in the conductor passage. The conductor member may be positioned in the housing such that the compression member is cooperatively secured in the conductor passage by the conductor member and the ledge.

According to some embodiments, the electrical connector includes a penetrable closure wall extending across the conductor passage and the positively pre-pressurized sealant applies a load against the closure wall prior to insertion of the conductor into the sealant. The closure wall may taper inwardly along a direction from the entrance opening to the exit opening.

In some embodiments, the electrical connector is a busbar connector. The housing defines a second port including: a second entrance opening; a second exit opening; and a second conductor passage extending between and communicating with the second entrance opening and the second exit opening, the conductor passage being adapted to receive a second conductor therethrough. A second flowable sealant is disposed in the second conductor passage, the second sealant being adapted for insertion of the second conductor therethrough and to the conductor member such that the second sealant provides a seal about the inserted second conductor. The second sealant is positively pre-pressurized prior to insertion of the conductor into the second sealant According to method embodiments of the present invention, a method for forming an electrical connector for use with a conductor includes providing a housing defining a port, the port including: an entrance opening; an exit opening; and a conductor passage extending between and communicating with the entrance and exit openings, the conductor passage being adapted to receive the conductor therethrough. The method further includes: placing a conductor member in the housing; placing a flowable sealant in the conductor passage, the sealant being adapted for insertion of the conductor therethrough and to the conductor member such that the sealant provides a seal about the inserted conductor; and positively pre-pressurizing the sealant in the conductor passage such that the sealant is positively pre-pressurized prior to insertion of the conductor into the sealant.

According to some embodiments, positively pre-pressurizing the sealant in the conductor passage includes: forcing a compression member into the conductor passage to displace the sealant; and retaining the compression member in a position to maintain a load against the sealant.

Positively pre-pressurizing the sealant in the conductor passage may include positively pre-pressurizing the sealant in the conductor passage to an internal pressure of at least 0.5 PSI.

In some embodiments, the sealant is a gel and the method includes pre-elastically elongating the gel in the conductor passage prior to insertion of the conductor into the gel. According to some embodiments, the method includes pre-elastically elongating the gel in the conductor passage by at least 5% prior to insertion of the conductor into the gel.

According to some embodiments, the housing includes a penetrable closure wall extending across the conductor passage, and positively pre-pressurizing the sealant in the conductor passage includes loading the sealant against the closure wall prior to insertion of the conductor into the sealant.

According to further method embodiments of the present invention, a method for forming an electrical connection with a conductor includes providing an electrical connector including a housing, a conductor member and a flowable sealant. The housing defines a port including: an entrance opening; an exit opening; and a conductor passage extending between and communicating with the entrance and exit openings, the conductor passage being adapted to receive the conductor therethrough. The conductor member is disposed in the housing. The sealant is disposed in the conductor passage and is adapted for insertion of the conductor therethrough and to the conductor member such that the sealant provides a seal about the inserted conductor. The method further includes inserting the conductor through the conductor passage and the sealant disposed therein such that the sealant provides a pressurized seal about the conductor. The sealant is positively pre-pressurized prior to inserting the conductor through the sealant.

According to some embodiments, inserting the conductor through the conductor passage and the sealant includes penetrating a closure wall with the conductor, the closure wall extending across the conductor passage between the entrance opening and the exit opening.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF THE EMBODIMENTS OF THE INVENTION

Figure 1:
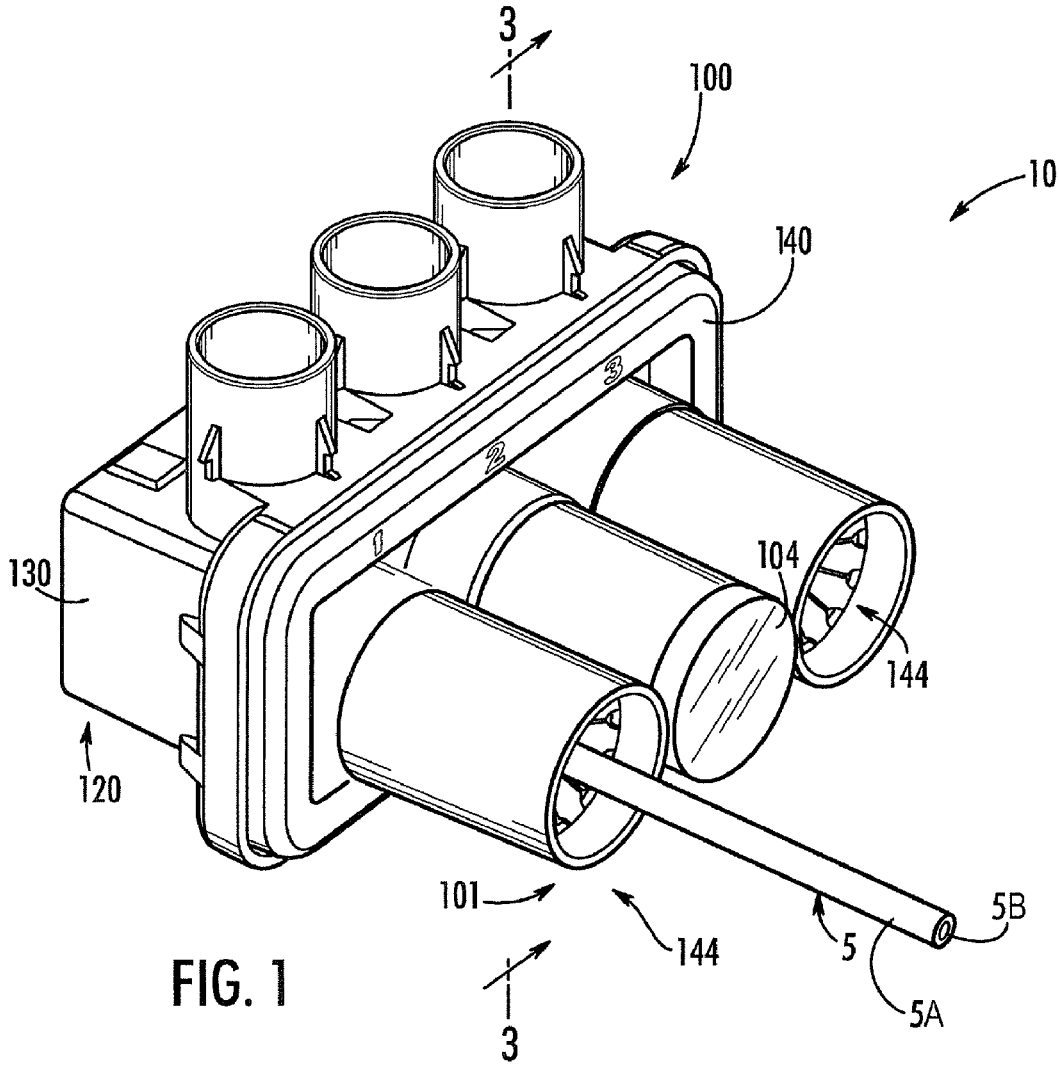
FIG. 1 is a perspective view of an electrical connection assembly including a busbar assembly according to embodiments of the present invention and a cable.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

Figure 11:
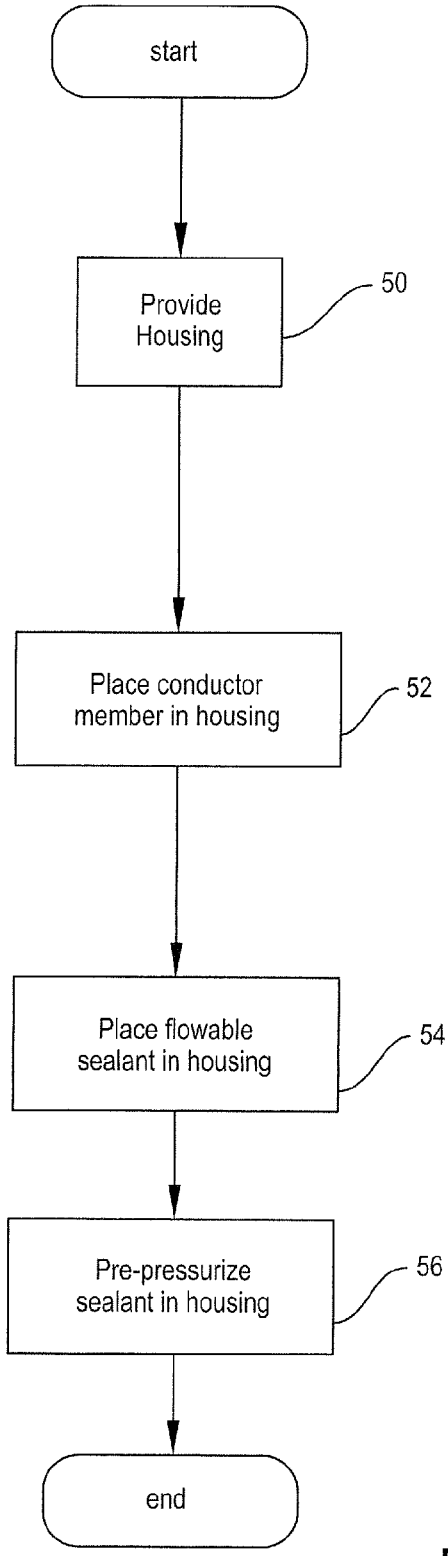
FIG. 11 is a flowchart representing methods for forming an electrical connection assembly according to embodiments of the present invention.

With reference to FIG. 11, methods according to embodiments of the present invention are schematically illustrated therein. A method is provided for forming an electrical connector for use with a conductor. A housing is provided defining a port (Block 50). The port includes an entrance opening, an exit opening, and a conductor passage extending between and communicating with the entrance and exit openings. The conductor passage is adapted to receive the conductor therethrough. A conductor member is placed in the housing (Block 52). A flowable sealant is placed in the conductor passage (Block 54). The sealant is adapted for insertion of the conductor therethrough and to the conductor member such that the sealant provides a seal about the inserted conductor. The sealant is positively pre-pressurized in the conductor passage such that the sealant is positively pre-pressurized prior to insertion of the conductor into the sealant (Block 56).

In some embodiments, the sealant is positively pre-pressurized by forcing a compression member into the conductor passage to displace the sealant and the compression member is retained in a position to maintain a load against the sealant. In some embodiments, the sealant is a gel and the gel is pre-elastically elongated in the conductor passage prior to insertion of the conductor into the gel. The housing may further include a penetrable closure wall extending across the conductor passage and the method can include loading the sealant against the closure wall prior to insertion of the conductor into the sealant.

Figure 2:
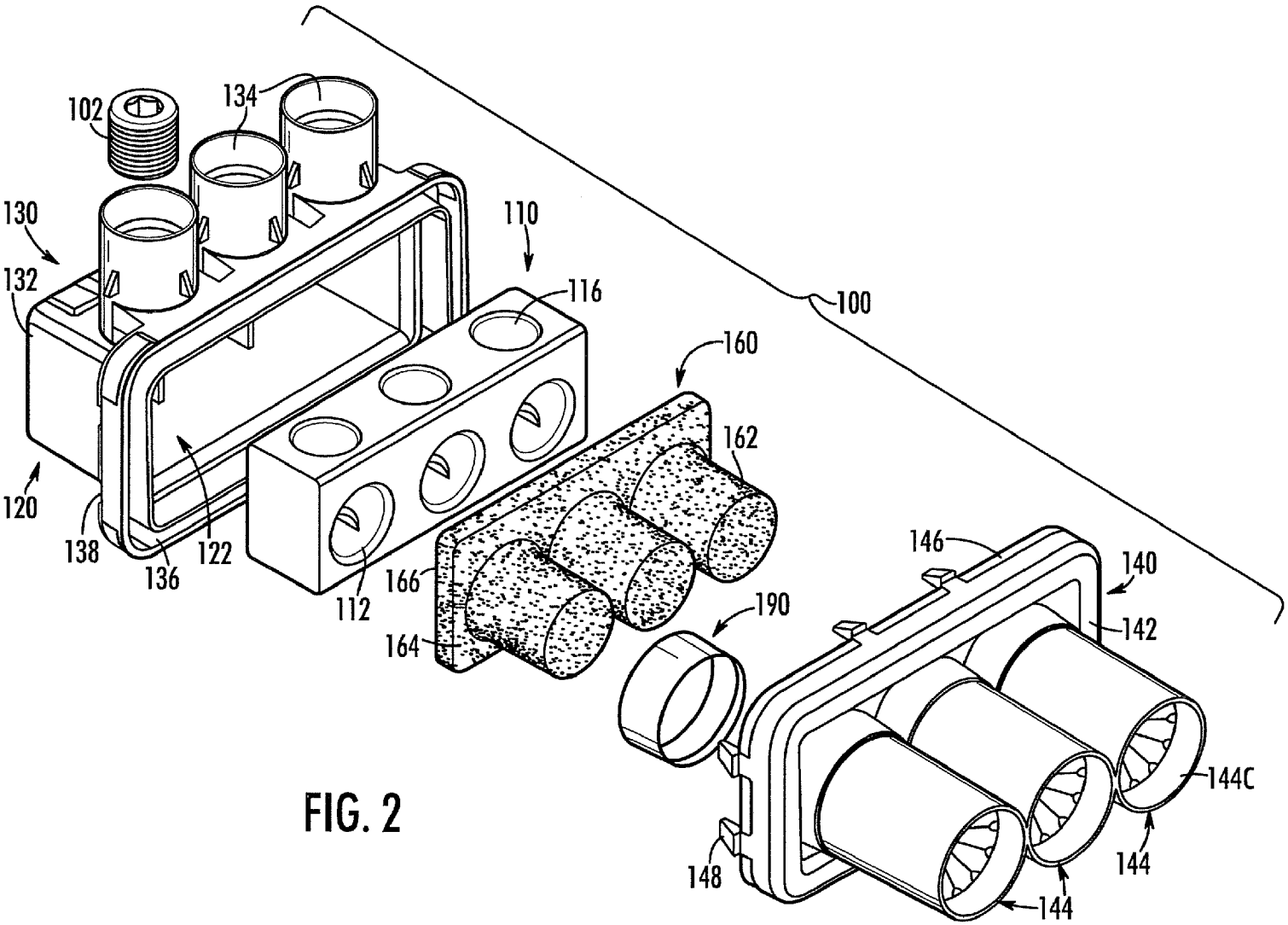
FIG. 2 is an exploded, perspective view of the busbar assembly of FIG. 1.
Figure 3:
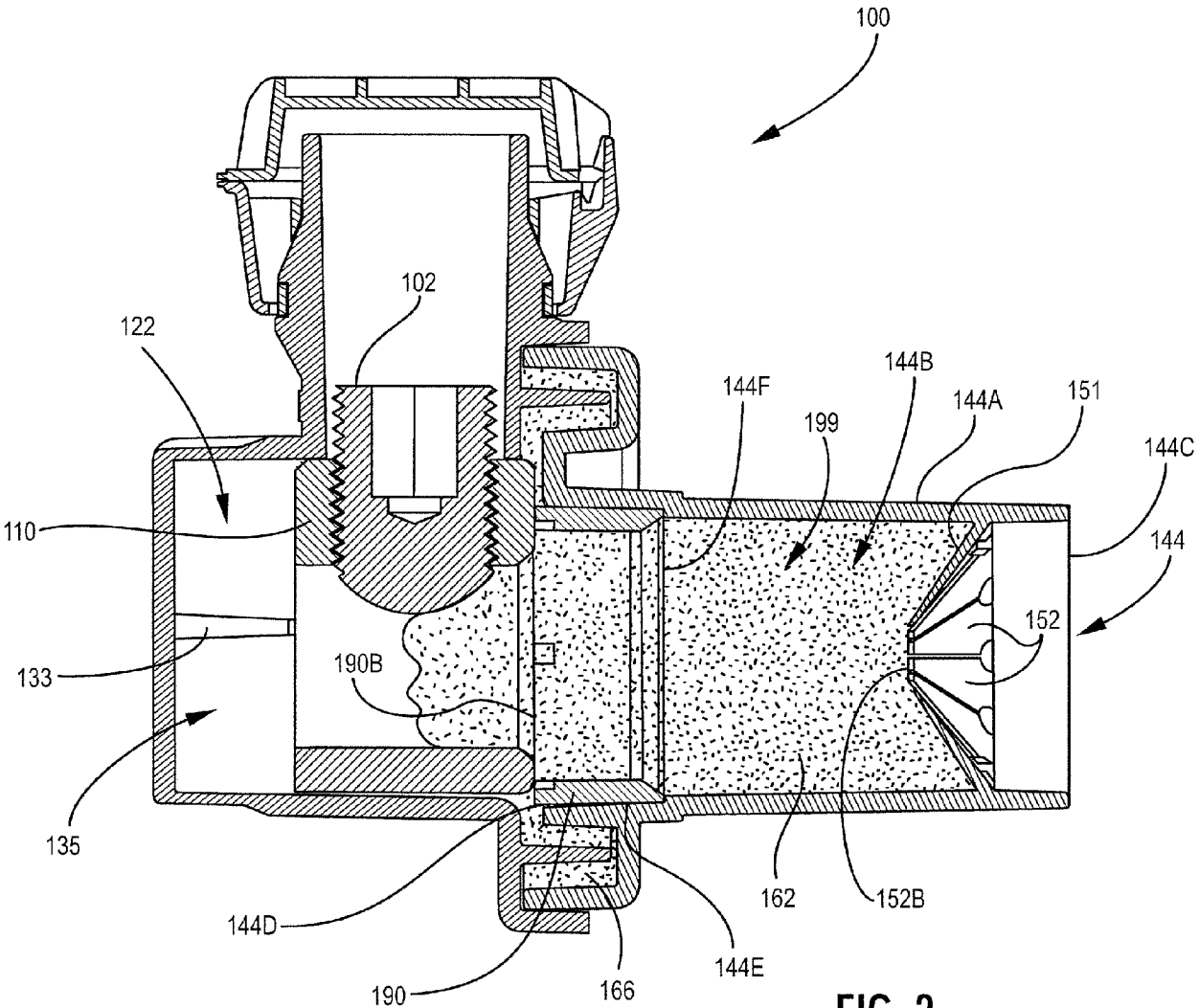
FIG. 3 is a cross-sectional view of the busbar assembly of FIG. 1 taken along the line 3-3 of FIG. 1.
Figure 4:
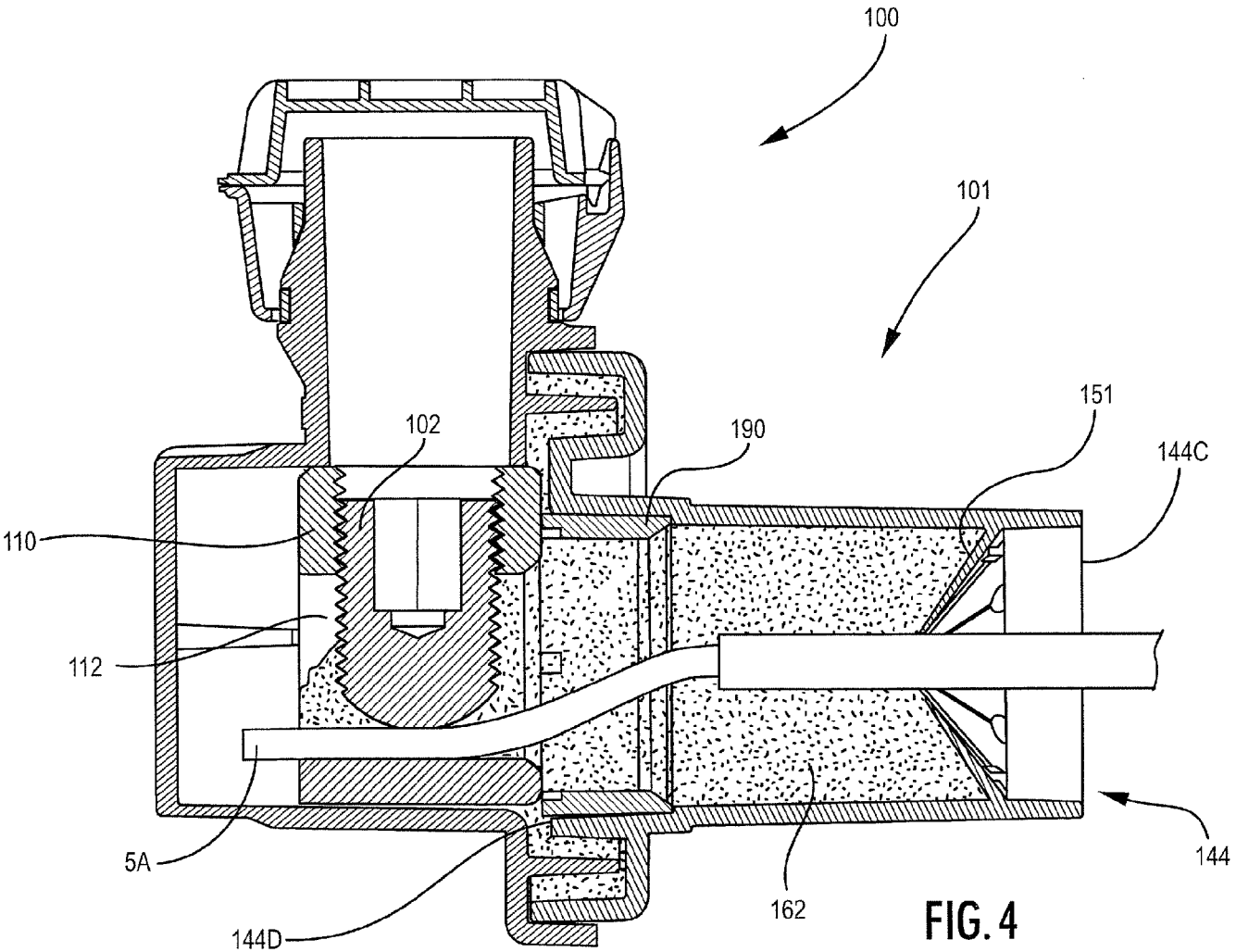
FIG. 4 is a cross-sectional view of the busbar assembly of FIG. 1 taken along the same line as the view of FIG. 3, and wherein a cable is installed in the busbar assembly.

With reference to FIGS. 1-10, an electrical connector or busbar assembly 100 according to embodiments of the present invention is shown therein. The busbar assembly 100 may be used to electrically connect a plurality of electrical conductors, such as the conductor 5A of an exemplary cable 5 (which further includes an electrically insulative sheath or cover 5B), as shown in FIGS. 1 and 4. The busbar assembly 100 may provide an environmentally protected and, according to some embodiments, watertight, connector and connection. For example, the busbar assembly 100 may be used to electrically connect the conductors of a power feed cable and one or more branch or tap cables, while preventing the conductive portions of the cables and the busbar assembly 100 from being exposed to surrounding moisture or the like.

Turning to the busbar assembly 100 in more detail and with reference to FIG. 2, the busbar assembly 100 includes a busbar conductor member 110, a cover assembly 120, a plurality of set screws 102, port caps 104 (FIG. 1), and a mass of sealant 160. The cover assembly 120 includes a rear cover member 130 and a front cover member 140. The cover assembly 120 defines an interior cavity 122 within which the conductor member 110 is disposed. The interior cavity 122 is environmentally protected.

The illustrated conductor member 110 includes three cable or conductor bores 112, each having a front opening 144. However, there may be more or fewer conductor bores 112. The conductor bores 112 are sized and shaped to receive conductors, such as the conductor 5A. Three threaded bores 116 extend orthogonally to and intersect respective ones of the conductor bores 112. The conductor member 110 may be formed of any suitable electrically conductive material. In some embodiments, the conductor member 110 is formed of copper or aluminum. In certain embodiments, the conductor member 110 is formed of aluminum. The conductor member 110 may be formed by molding, stamping, extrusion and/or machining, or by any other suitable process(es).

The rear cover member 130 includes a body portion 132. A transversely extending rib 133 (FIG. 3) projects into the interior cavity 122 from the body portion 132. Three access ports 134 are provided on the body portion 132. However, there may be more or fewer access ports 134. Each access port 134 communicates with the interior cavity 122. A perimeter flange 136 extends about the body portion 132. A plurality of latch slots 138 are formed in the flange 136.

The front cover member 140 includes a body portion 142. Three conductor or cable ports 144 are provided on the body portion 142. As shown in FIG. 3, each port 144 includes a cable tube 144A defining a cable passage 144B. The cable passage 144B communicates with an entrance opening 144C and an exit opening 144D. There may be more or fewer ports 144.

A penetrable closure wall 151 extends across the passage 144B between the openings 144C and 144D. The closure wall 151 may be integrally molded with the tube 144A. The closure wall 151 may include a plurality of discrete fingers or flaps 152 which may be separated by gaps. The flaps 152 may be flexible. According to some embodiments, the flaps 152 are also resilient.

According to some embodiments, the flaps 152 are concentrically arranged and taper inwardly in an inward direction from the entrance opening 144C to the exit opening 144D to form a generally conical or frusto-conical shape. According to some embodiments, the angle of taper is between about 10 and 60 degrees. The closure wall 151 defines a hole 152B that may be centrally located. According to some embodiments, the inner diameter D2 of the hole 152B (with the flaps 152 in a relaxed position) is less than the outer diameter of the cable or cables (e.g., the cable 5) with which the busbar assembly 100 is intended to be used. However, according to some embodiments, the diameter D2 may be greater than the outer diameter of cables with which the busbar assembly 110 is intended to be used. The thickness of the flaps 152 may taper in a radially inward direction. According to some embodiments, the thickness of the flaps 152 tapers in the radially inward direction at a rate of between about zero and 50 percent/inch.

A perimeter flange 146 surrounds and projects rearwardly from the body portion 142. A plurality of barbed latch projections 148 extend rearwardly from the flange 146.

According to some embodiments, the front cover member 140 is integrally formed and the rear cover member 130 is integrally formed. The cover members 130, 140 may be formed of any suitable electrically insulative material. According to some embodiments, the cover members 130, 140 are formed of a molded polymeric material, such as polypropylene, polyethylene and/or a thermoplastic elastomer. According to some embodiments, one or both of the cover members 130, 140 are formed of a translucent material such as polycarbonate, clarified polypropylene, and/or methyl pentene. The cover members 130, 140 may be formed of a flame retardant material, and may include a suitable additive to make the cover members 130, 140 flame retardant.

The busbar assembly 100 further includes three compression members 190, each of which is positioned in the passage 144B of a respective one of the ports 144. Referring to FIG. 3, each compression member 190 is positioned in the passage 144B adjacent the exit opening 144D. The compression member 190 is seated in a recess 144E in the tube 144A and positively captured between a ledge 144F and the front face of the conductor member 110. Additionally or alternatively, the compression member 190 may be otherwise secured within the passage 144B, for example, by welding, adhesive, friction fit, a mechanical latch or latches, one or more fasteners or the like.

Each compression member 190 may be annular or ring-shaped as shown. With reference to FIGS. 7-10, the compression member 190 has a front end 190A, a rear end 190B, an inner surface 192 and an outer surface 194. The inner surface 192 defines a passage 196. The inner surface 192 has an entrance portion 192A that tapers inwardly from the front end 190A and defines a frusto-conical entrance portion of the passage 196. The inner surface 192 also has a cylindrical main portion 192B and a rounded transition portion 192C between the portions 192A and 192B. According to some embodiments and as illustrated, the inner surface 192 is substantially smooth. According to some embodiments, the inner surface 192 tapers at an angle of between about 10 and 60 degrees with respect to a central longitudinal axis A-A (FIG. 10) of the passage 194. The outer surface 194 of the compression member 190 is substantially cylindrical. Recesses 197 are defined in the compression member adjacent the rear end 190B. The recesses 197 may serve as visual cues to correct orientation during part assembly and/or as keying features for assembly equipment.

According to some embodiments, the compression member 190 is substantially rigid. According to some embodiments, the compression member 190 has a flexural modulus of at least about 10,000 PSI and, according to some embodiments, at least about 100,000 PSI. The compression member 190 can be formed of any suitable material. According to some embodiments, the compression member 190 is formed of a polymeric material. According to some embodiments, the compression member 190 is formed of polypropylene, nylon, and/or other engineered polymer.

According to some embodiments and as shown, the compression member 190 is devoid of any closure wall or membrane extending across the passage 196. According to some embodiments, the nominal or smallest diameter D1 (FIG. 9) of the passage 196 is greater than the outer diameter of the largest prescribed cable intended to be received in the port 144. According to some embodiments, the diameter D1 is at least 2% greater than the outer diameter of the largest cable intended to be received in the port 144. According to some embodiments, the diameter D1 is in the range of from about 1.1 to 0.9 inches.

The sealant 160 is disposed in the cover assembly 120. A body sealant portion 164 of the sealant 160 is disposed in a front portion of the interior cavity 122. The sealant portion 164 includes a perimeter portion 166 that is disposed in the flange 136 to form a surrounding seal between the cover members 130, 140. According to some embodiments, the sealant 160 is a gel.

Figure 6:
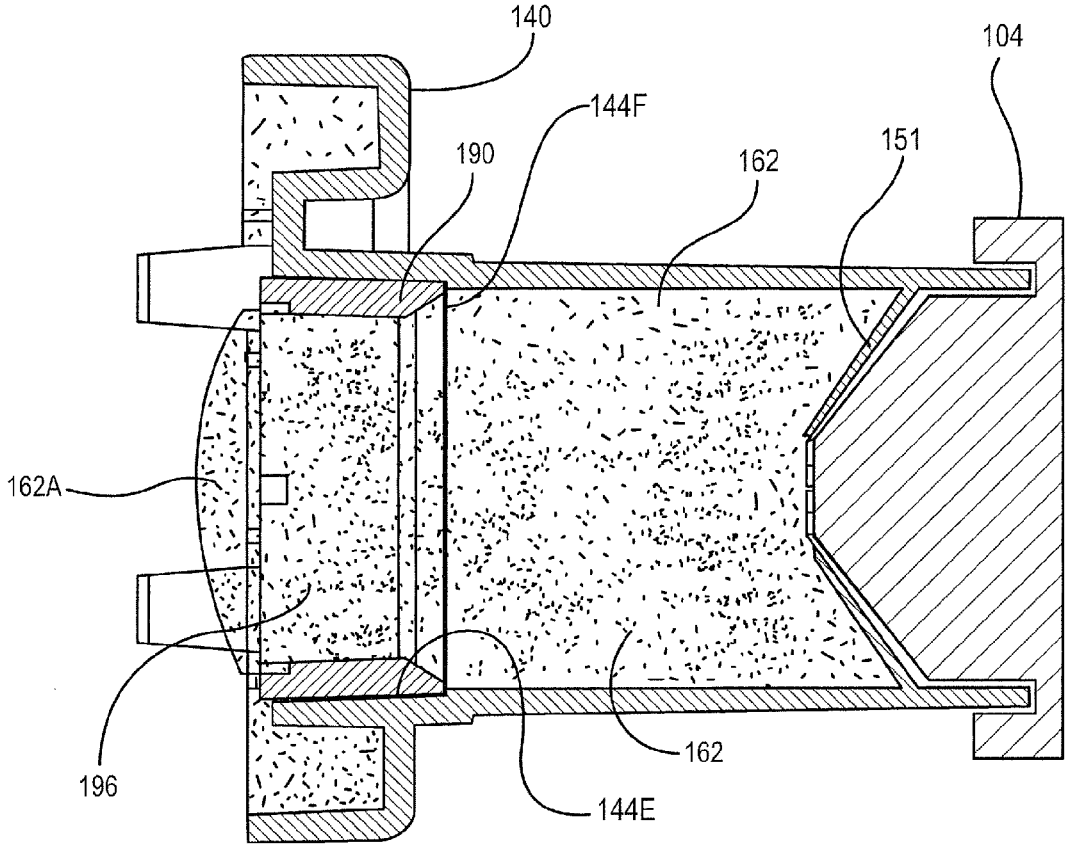
FIG. 6 is a cross-sectional view of the compression member, the front cover member and the sealant of the busbar assembly of FIG. 1, wherein the compression member has been installed in the front cover member.
Figure 7:
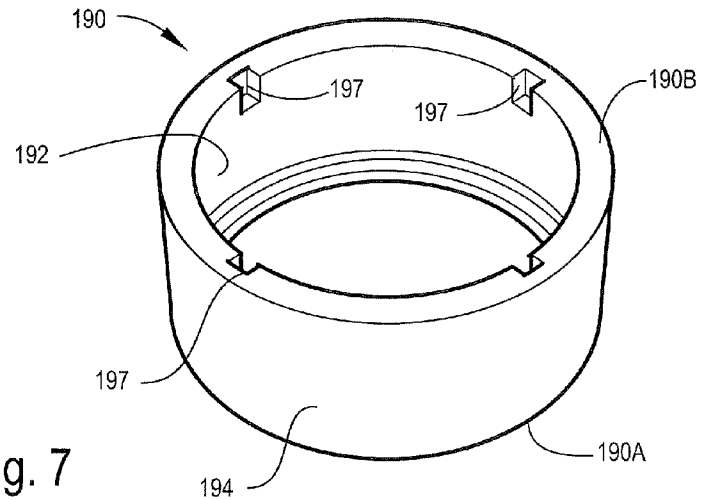
FIG. 7 is a rear perspective view of a compression member forming a part of the busbar assembly of FIG. 1.
Figure 8:
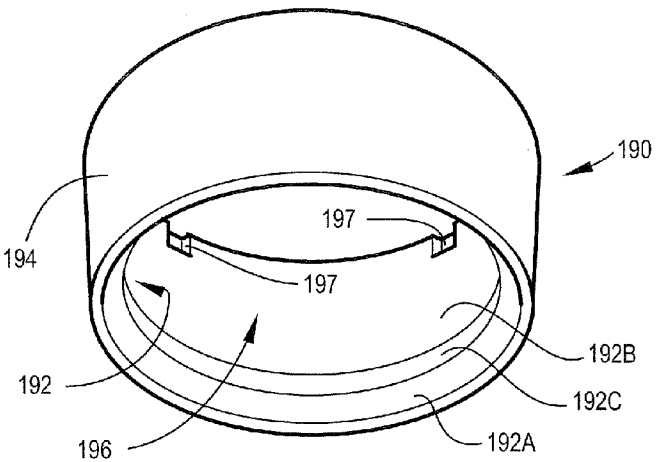
FIG. 8 is a front perspective view of the compression member of FIG. 7.
Figure 9:
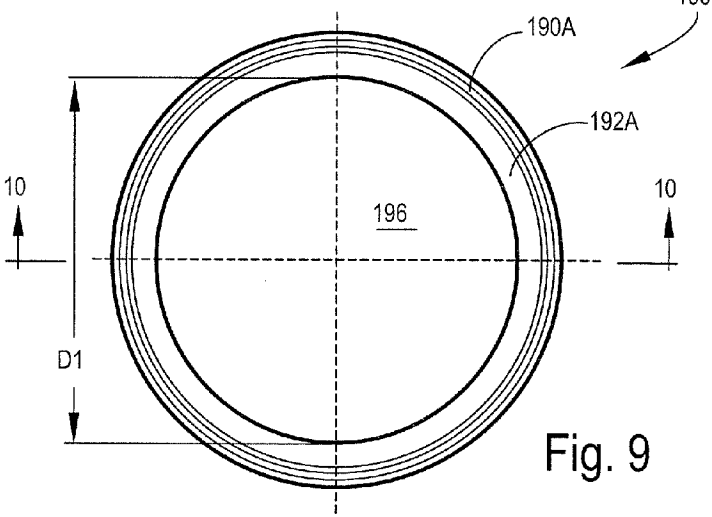
FIG. 9 is a top plan view of the compression member of FIG. 7.
Figure 10:
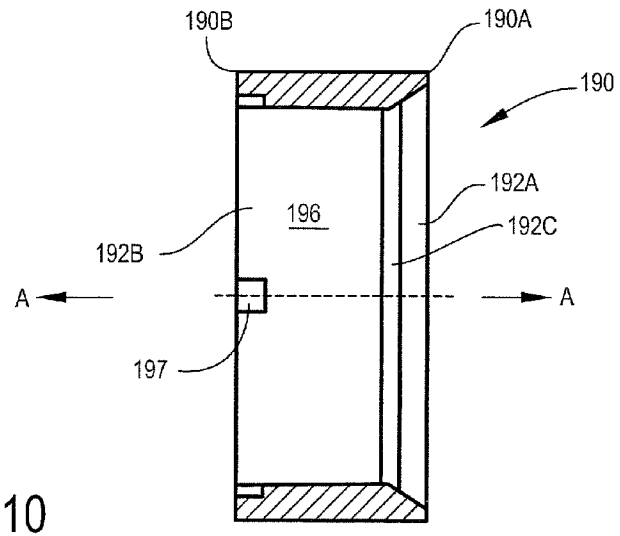
FIG. 10 is a cross-sectional view of the compression member of FIG. 7 taken along the line 10-10 of FIG. 9.

A plurality of port sealant portions 162 are disposed in respective ones of the ports 144. In some embodiments and as illustrated, each port sealant portion 162 extends continuously from the inner side of the closure wall 151 and through the compression member 190 such that a portion 162A of the sealant 162 extends beyond the exit or rear end 190B of the compression member 190. The closure wall 151 and the cable tube 144A of each port 144 define a sealing chamber or region 199 therebetween (FIG. 3). The corresponding portion 162 of the sealant 160 is disposed in the sealing region 199. According to some embodiments, the sealant 162 substantially fills the sealing region 199. According to some embodiments, the port caps 104 substantially conform to the closure walls 151 as shown in FIG. 6. According to some embodiments, the sealant 160 extends past the closure wall 151 toward the exit opening 144D, in which case the port caps 104 may be non-conforming to the closure wall 151.

Each of three set screws 102 is threadedly installed in a respective one of the threaded bores 116. Each of the screws 102 includes a socket that may be adapted to receive a driver, for example. Plugs or caps may be provided to selectively cover the access ports 134.

Figure 5:
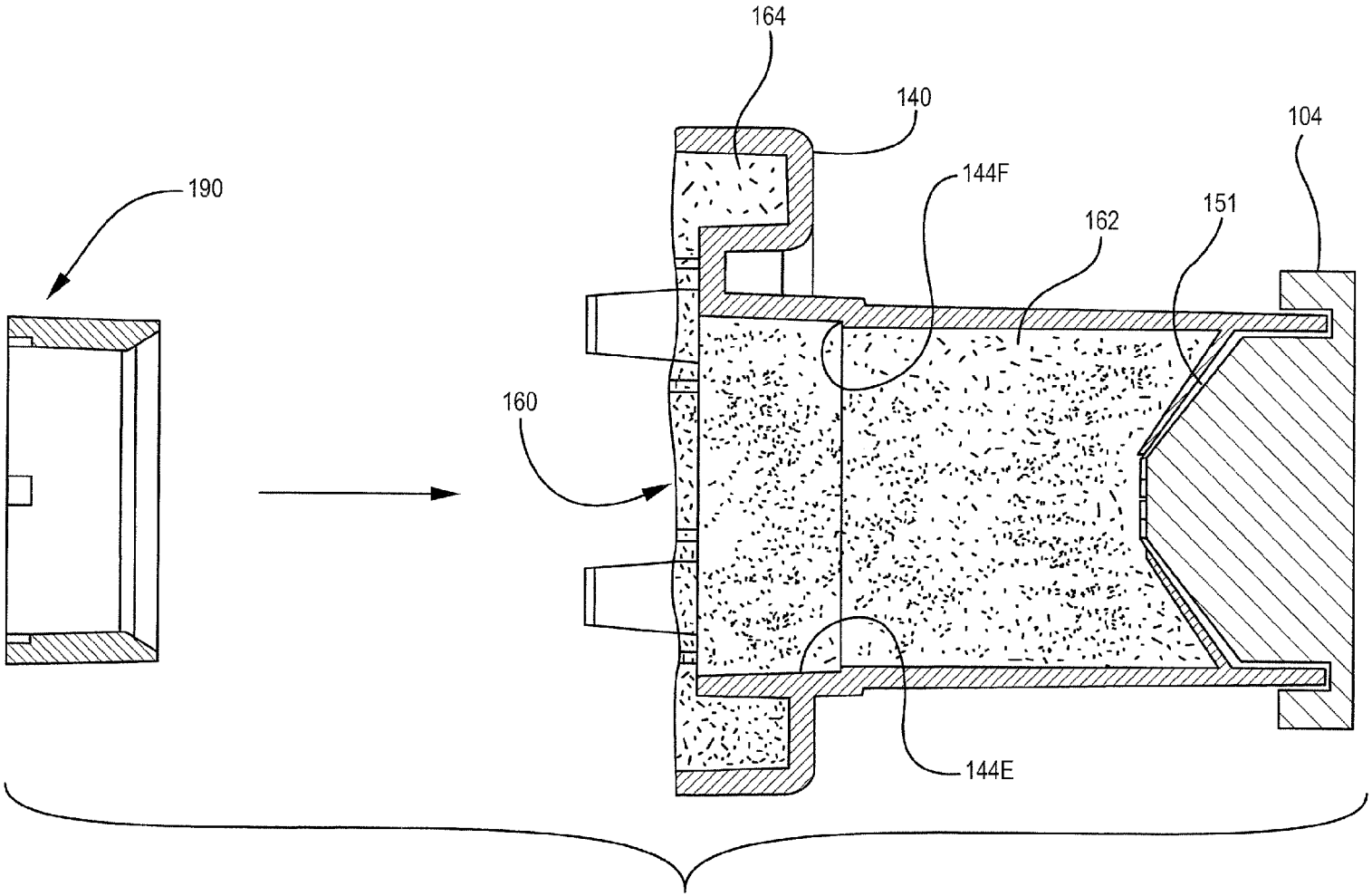
FIG. 5 is a cross-sectional view of a compression member, a front cover member and sealant of the busbar assembly of FIG. 1, wherein the compression member has not yet been installed in the front cover member.

The busbar assembly 100 may be formed or assembled in the following manner. If the sealant 160 requires curing, such as a curable gel, the sealant may be cured in situ. The front cover member 140 is oriented vertically with the body portion 142 over the ports 144, which are plugged by the port caps 104 below the closure walls 151. Liquid, uncured sealant is dispensed into the front cover member 140, such that it fills the cable passages 144B above the closure walls 151 and also fills a portion of the body member 142. The sealant 160 is then cured in situ and may take the form as shown in FIG. 5.

Each compression member 190 is then forced into its respective passage 144B through the exit opening 144D. According to some embodiments, the compression member 190 is forced into its passage 144B until the compression member 190 seats against the ledge 144F as shown in FIG. 6. Installation of the compression member 190 applies a compressive load to the sealant portion 162 that displaces a volume or portion of the sealant portion 162, forcing the portion 162A to extrude through the passage 196.

According to some embodiments, the compression member 190, when fully installed, displaces at least about 5% of the initial volume of the sealant portion 162 and, according to some embodiments, between about 7 and 15%.

According to some embodiments, the busbar assembly 100 is configured such that prior to insertion of a cable or the like, the sealant portion 162 has an elongation at the interface between the sealant portion 162 and the compression member 190 of at least 5% and, according to some embodiments, between about 7 and 15%.

The displacement of the sealant portion 162 by the compression member 190 elastically elongates or deforms the sealant portion 162 so that a restoring force is generated in the sealant portion 162. The restoring force creates an elevated, positive internal pressure in the sealant portion 162 and causes the sealant to load or bear against mating surfaces of the cover member 140 and the compression member 190. The end cap 104 and/or the construction and configuration of the closure wall 151 may prevent or limit deflection of the closure wall 151 or extrusion of the sealant portion 162 through the closure wall 151.

The cover members 130, 140 are joined and interlocked by means of the latch slots 138 and the latch projections 148 about the conductor member 110. The set screws 102 are installed in the threaded bores 116 through the access ports 134. The set screws 102 may be pre-installed in the connector member 110. According to some embodiments, the compression members 190 are partially pressed into place in the passages 144B, the conductor member 110 is then placed over the compression members 190, and the compression members 190 are then forcibly pushed into their final positions by the connector member 110 when the cover members 130, 140 are forced into engagement.

In the foregoing manner, the sealant portion 162 is positively pre-pressurized by compressive pre-loading. More particularly, the sealant portion 162 is elastically pre-elongated. The compressive loading and elastic elongation of the sealant portion 162 are maintained, at least in part, until and after insertion of a cable 5 through the sealant to effect a sealed connection.

The compression members 190 may be held in place on the sealant 160 by the tackiness of the sealant (e.g., gel) prior to installation of the connector member 110 and the cover member 130. According to some embodiments, the compression members 190 may be temporarily or permanently secured in the recesses 144E by any suitable method such as, for example, welding, adhesive, friction fit, a mechanical latch or latches, a fastener or fasteners, a holding jig and/or the like.

According to some embodiments, the sealant portion 162 is pre-elongated such that an internal pressure of the sealant portion 162 is at least 0.5 PSI, according to some embodiments, at least 1.0 PSI, and according to some embodiments, at least 5.0 PSI.

Referring to FIGS. 3 and 4, the busbar assembly system 10 may be used in the following manner. The busbar assembly 100 may be used to form an electrical connection assembly 101 as shown in FIG. 4. The connection assembly 101 includes the busbar assembly 100 and the cable 5, and may include additional cables secured to the busbar assembly 100 in the manner described immediately hereinafter.

With the set screw 102 in a raised position, the cable 5 is inserted into the selected port 144 such that the terminal end of the cable 5 (which has an exposed portion of the conductor 5A) is inserted through the entrance opening 144C, the passage 144A, and the exit opening 144D, and into the conductor bore 112. The cable 5 penetrates and/or displaces the closure wall 151 and the sealant 160 (including the sealant portion 162), and passes through the compression member passage 196 as shown in FIG. 4. The cable 5 may elastically deflect the flaps of the closure wall 151. As shown, the busbar assembly 100 may be configured such that the interior cavity 122 includes a volume of a compressible gas (e.g., air) to allow insertion of the cable 5 without a proportionate displacement of the sealant 160 out of the interior cavity 122.

According to some embodiments, the compression member 190 is configured and formed of a sufficiently rigid material such that the cable 5 will not deform any part of the compression member 190. As discussed above, the compression member 190 may be configured such that the nominal diameter of the passage 196 exceeds the largest diameter of any intended or selected cable 5. Accordingly, the compression member 190 may prevent or minimize interference between the compression member 190 and the cable 5.

The set screw 102 is then rotatively driven (for example, using a driver) into the threaded bore 116 to force the exposed portion of the conductor 5A against the opposing wall of the bore 112. In this manner, the cable 5 is mechanically secured to or captured within the busbar assembly 100 and electrically connected to the conductor member 110. One or more additional cables may be inserted through the other ports 144 and secured using the other set screws 102. In this manner, such other cables are thereby electrically connected to the cable 5 and to one another through the conductor member 110.

According to some embodiments, two or more cables may be installed in a single port 144.

The busbar assembly 100 may provide a reliable (and, in at least some embodiments, moisture-tight) seal between the busbar assembly 100 and the cable 5, as well as any additional cables secured in the ports 144. The sealant 160, particularly gel sealant, may accommodate cables of different sizes within a prescribed range. The ports 144 that do not have cables installed therein are likewise sealed by the sealant 160.

As discussed above, according to some embodiments, the sealant 160 is a gel. As used herein, "gel" refers to the category of materials which are solids extended by a fluid extender. The gel may be a substantially dilute system that exhibits no steady state flow. As discussed in Ferry, "Viscoelastic Properties of Polymers," 3rd ed. P. 529 (J. Wiley & Sons, New York 1980), a polymer gel may be a cross-linked solution whether linked by chemical bonds or crystallites or some other kind of junction. The absence of the steady state flow may be considered to be the definition of the solid-like properties while the substantial dilution may be necessary to give the relatively low modulus of gels. The solid nature may be achieved by a continuous network structure formed in the material generally through crosslinking the polymer chains through some kind of junction or the creation of domains of associated substituents of various branch chains of the polymer. The crosslinking can be either physical or chemical as long as the crosslink sites may be sustained at the use conditions of the gel.

Gels for use in this invention may be silicone (organopolysiloxane) gels, such as the fluid-extended systems taught in U.S. Pat. No. 4,634,207 to Debbaut (hereinafter "Debbaut '207"); U.S. Pat. No. 4,680,233 to Camin et al.; U.S. Pat. No. 4,777,063 to Dubrow et al.; and U.S. Pat. No. 5,079,300 to Dubrow et al. (hereinafter "Dubrow '300"), the disclosures of each of which are hereby incorporated herein by reference. These fluid-extended silicone gels may be created with non-reactive fluid extenders as in the previously recited patents or with an excess of a reactive liquid, e.g., a vinyl-rich silicone fluid, such that it acts like an extender, as exemplified by the Sylgard® 527 product commercially available from Dow-Corning of Midland, Mich. or as disclosed in U.S. Pat. No. 3,020,260 to Nelson. Because curing is generally involved in the preparation of these gels, they are sometimes referred to as thermosetting gels. The gel may be a silicone gel produced from a mixture of divinyl terminated polydimethylsiloxane, tetrakis (dimethylsiloxy)silane, a platinum divinyltetramethyldisiloxane complex, commercially available from United Chemical Technologies, Inc. of Bristol, Pa., polydimethylsiloxane, and 1,3,5,7-tetravinyltetra-methylcyclotetrasiloxane (reaction inhibitor for providing adequate pot life).

Other types of gels may be used, for example, polyurethane gels as taught in the aforementioned Debbaut '261 and U.S. Pat. No. 5,140,476 to Debbaut (hereinafter "Debbaut '476") and gels based on styrene-ethylene butylenestyrene (SEBS) or styrene-ethylene propylene-styrene (SEPSS) extended with an extender oil of naphthenic or nonaromatic or low aramatic content hydrocarbon oil, as described in U.S. Pat. No. 4,369,284 to Chen; U.S. Pat. No. 4,716,183 to Gamarra et al.; and U.S. Pat. No. 4,942,270 to Gamarra. The SEBS and SEPS gels comprise glassy styrenic microphases interconnected by a fluid-extended elastomeric phase. The microphase-separated styrenic domains serve as the junction points in the systems. The SEBS and SEPS gels are examples of thermoplastic systems.

Another class of gels which may be used are EPDM rubber-based gels, as described in U.S. Pat. No. 5,177,143 to Chang et al.

Yet another class of gels which may be used are based on anhydride-containing polymers, as disclosed in WO 96/23007. These gels reportedly have good thermal resistance.

The gel may include a variety of additives, including stabilizers and antioxidants such as hindered phenols (e.g., Irganox™ 1076, commercially available from Ciba-Geigy Corp. of Tarrytown, N.Y.), phosphites (e.g., Irgafos™168, commercially available from Ciba-Geigy Corp. of Tarrytown, N.Y.), metal deactivators (e.g., Irganox™ D1024 from Ciba-Geigy Corp. of Tarrytown, N.Y.), and sulfides (e.g., Cyanox LTDP, commercially available from American Cyanamid Co. of Wayne, N.J.), light stabilizers (e.g., Cyasorb UV-531, commercially available from American Cyanamid Co. of Wayne, N.J.), and flame retardants such as halogenated paraffins (e.g., Bromoklor 50, commercially available from Ferro Corp. of Hammond, Ind.) and/or phosphorous containing organic compounds (e.g., Fyrol PCF and Phosflex 390, both commercially available from Akzo Nobel Chemicals Inc. of Dobbs Ferry, N.Y.) and acid scavengers (e.g., DHT-4A, commercially available from Kyowa Chemical Industry Co. Ltd through Mitsui & Co. of Cleveland, Ohio, and hydrotalcite). Other suitable additives include colorants, biocides, tackifiers and the like described in "Additives for Plastics, Edition 1" published by D.A.T.A., Inc. and The International Plastics Selector, Inc., San Diego, Calif.

The hardness, stress relaxation, and tack may be measured using a Texture Technologies Texture Analyzer TA-XT2 commercially available from Texture Technologies Corp. of Scarsdale, N.Y., or like machines, having a five kilogram load cell to measure force, a 5 gram trigger, and ¼ inch (6.35 mm) stainless steel ball probe as described in Dubrow '300, the disclosure of which is incorporated herein by reference in its entirety. For example, for measuring the hardness of a gel a 60 mL glass vial with about 20 grams of gel, or alternately a stack of nine 2 inch×2 inch×⅛" thick slabs of gel, is placed in the Texture Technologies Texture Analyzer and the probe is forced into the gel at the speed of 0.2 mm/sec to a penetration distance of 4.0 mm. The hardness of the gel is the force in grams, as recorded by a computer, required to force the probe at that speed to penetrate or deform the surface of the gel specified for 4.0 mm. Higher numbers signify harder gels. The data from the Texture Analyzer TA-XT2 may be analyzed on an IBM PC or like computer, running Microsystems Ltd, XT.RA Dimension Version 2.3 software.

The tack and stress relaxation are read from the stress curve generated when the XT.RA Dimension version 2.3 software automatically traces the force versus time curve experienced by the load cell when the penetration speed is 2.0 mm/second and the probe is forced into the gel a penetration distance of about 4.0 mm. The probe is held at 4.0 mm penetration for 1 minute and withdrawn at a speed of 2.00 mm/second. The stress relaxation is the ratio of the initial force ($F_i$) resisting the probe at the pre-set penetration depth minus the force resisting the probe ($F_f$) after 1 min divided by the initial force $F_i$, expressed as a percentage. That is, percent stress relaxation is equal to $$\frac{(F_i - F_f)}{F_i} \times 100\%$$

where $F_i$ and $F_f$ are in grams. In other words, the stress relaxation is the ratio of the initial force minus the force after 1 minute over the initial force. It may be considered to be a measure of the ability of the gel to relax any induced compression placed on the gel. The tack may be considered to be the amount of force in grams resistance on the probe as it is pulled out of the gel when the probe is withdrawn at a speed of 2.0 mm/second from the preset penetration depth.

An alternative way to characterize the gels is by cone penetration parameters according to ASTM D-217 as proposed in Debbaut '261; Debbaut '207; Debbaut '746; and U.S. Pat. No. 5,357,057 to Debbaut et al., each of which is incorporated herein by reference in its entirety. Cone penetration ("CP") values may range from about 70 ($10^{-1}$ mm) to about 400 ($10^{-1}$ mm). Harder gels may generally have CP values from about 70 ($10^{-1}$ mm) to about 120 ($10^{-1}$ mm). Softer gels may generally have CP values from about 200 ($10^{-1}$ mm) to about 400 ($10^{-1}$ mm), with particularly preferred range of from about 250 ($10^{-1}$ mm) to about 375 ($10^{-1}$ mm). For a particular materials system, a relationship between CP and Voland gram hardness can be developed as proposed in U.S. Pat. No. 4,852,646 to Dittmer et al.

According to some embodiments, the gel has a Voland hardness, as measured by a texture analyzer, of between about 5 and 100 grams force. The gel may have an elongation, as measured by ASTM D-638, of at least 55%. According to some embodiments, the elongation is of at least 100%. The gel may have a stress relaxation of less than 80%. The gel may have a tack greater than about 1 gram. Suitable gel materials include POWERGEL sealant gel available in products from Tyco Electronics Energy Division of Fuquay-Varina, N.C. under the RAYCHEM brand.

When the sealant 160 is a gel, the cable 5 and the tube 144A apply a compressive force to the sealant 160 as the cable 5 is inserted into the busbar assembly 100. The gel is thereby elongated and is generally deformed and substantially conforms to the outer surface of the cable 5 and to the inner surface of the tube 144A. Some shearing of the gel may occur as well. The elongated gel may extend into and through the conductor bore 112. Moreover, the elongated gel may extend beyond the conductor member 110 into an expansion chamber 135 (FIG. 3) created by the ribs 133. The restoring force in the gel resulting from elastic memory of the gel causes the gel to operate as a spring exerting an outward force between the tube 144A and the cable 5.

The pre-compressive loading of the sealant portion 162 may enable the busbar assembly 100 to effectively seal a wider range of cable sizes, including cables of relatively small diameter. In particular, because the sealant portion 162 is elastically pre-elongated, the sealant portion 162 will be sufficiently loaded against the cable and the tube 144A even if the cable causes relatively little displacement, and therefore little additional elastic elongation, of the sealant portion 162.

Various properties of the gel, as described above, may ensure that the gel sealant 160 maintains a reliable and long lasting hermetic seal between the tube 144A and the cable 5. The elastic memory of and the restoring force retained in the elongated, elastically deformed gel generally cause the gel to bear against the mating surfaces of the cable 5 and the interior surface of the tube 144A. Also, the tack of the gel may provide adhesion between the gel and these surfaces. The gel, even though it is cold-applied, is generally able to flow about the cable 5 and the busbar assembly 100 to accommodate their irregular geometries.

Preferably, the sealant 160 is a self-healing or self-amalgamating gels. This characteristic, combined with the aforementioned compressive force between the cable 5 and the tube 144A, may allow the sealant 160 to re-form into a continuous body if the gel is sheared by the insertion of the cable 5 into the connector 100. The gel may also re-form if the cable 5 is withdrawn from the gel.

The sealant 160, particularly when formed of a gel as described herein, may provide a reliable moisture barrier for the cable 5 and the conductor member 110, even when the connection 101 is submerged or subjected to extreme temperatures and temperature changes. Preferably, the cover members 130, 140 are made from an abrasion-resistant material that resists being punctured by the abrasive forces.

According to some embodiments, the busbar assembly 100 is configured to provide an environmental seal compliant with ANSI C119.1-2002 for cables having a minimum diameter of #14 AWG.

According to some embodiments, the busbar assembly 100 is configured to provide an environmental seal compliant with ANSI C119.1-2002 for cables having a maximum diameter of 350 MCM AWG.

While the annular compression member 190 is shown and described herein, any suitable compression insert or device may be employed in accordance with embodiments of the present invention. According to some embodiments, any device or mechanism that pre-compresses (i.e., pre-loads or elastically pre-elongates) the sealant after it has been cured but before it has been put into service can be used. According to some embodiments, the sealant is contained in a housing defining a fixed volume and the cable is inserted through a penetrable wall in addition to the sealant.

While, in accordance with some embodiments, the sealants 160 is a gel as described above, other types of elastically elongatable sealants may be employed. For example, the sealant 160 may be silicone grease or hydrocarbon grease.

The closure wall 151 may be otherwise constructed so as to be penetrable and displaceable. For example, the closure wall 151 may be constructed so as to be fully or partly frangible, to lack a preformed hole, and/or with or without a taper. As a further alternative, the closure wall may be constructed as a resilient, elastic membrane or panel having a preformed hole therein, the closure wall being adapted to stretch about the hole to accommodate the penetrating cable without rupturing. In such case, the hole is preferably smaller in diameter than the outer diameter of the intended cable.

The access ports 134 may also be environmentally sealed in any suitable manner. According to some embodiments, the ports 134 and/or the caps overlying the ports 134 may be sealant-filled (e.g., filled with a gel as described herein) to provide a seal.

While three cable ports and conductor bores and three access ports, screw bores and set screws are shown in the busbar assembly 100, busbar assemblies according to the present invention may include more or fewer cable ports and/or access ports and corresponding or associated components as needed to allow for the connection of more or fewer cables.

While the present invention has been described herein with reference to busbar assemblies, various of the features and inventions discussed herein may be provided in other types of connectors.

Connectors according to the present invention may be adapted for various ranges of voltage. It is particularly contemplated that multi-tap connectors of the present invention employing aspects as described above may be adapted to effectively handle voltages in the range of 120 to 1000 volts.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

We claim:

1. An electrical connector for use with a conductor, the electrical connector comprising:

a) a housing defining a port, the port including:
an entrance opening;
an exit opening; and
a conductor passage extending between and communicating with the entrance and exit openings, the conductor passage being adapted to receive the conductor therethrough;

b) a conductor member disposed in the housing; and c) a flowable sealant disposed in the conductor passage, the sealant being adapted for insertion of the conductor therethrough and to the conductor member such that the sealant provides a seal about the inserted conductor;

d) wherein the sealant is positively pre-pressurized prior to insertion of the conductor into the sealant.

2. The electrical connector of claim 1 wherein the sealant is positively pre-pressurized such that an internal pressure of the sealant in the conductor passage is at least 0.5 PSI.

3. The electrical connector of claim 1 wherein the sealant is a gel.

4. The electrical connector of claim 3 wherein the gel is elastically pre-elongated prior to insertion of the conductor into the gel.

5. The electrical connector of claim 4 wherein the gel is elastically pre-elongated by at least 5% prior to insertion of the conductor into the gel.

6. The electrical connector of claim 1 including a compression member disposed in the conductor passage and, wherein the positively pre-pressurized sealant applies a load against the compression member prior to insertion of the conductor into the sealant.

7. The electrical connector of claim 6 wherein the compression member is ring-shaped and defines a compression member passage, and the electrical connector is configured such that the conductor extends through the compression member passage to engage the conductor member.

8. The electrical connector of claim 1 including a penetrable closure wall extending across the conductor passage, wherein the positively pre-pressurized sealant applies a load against the closure wall prior to insertion of the conductor into the sealant.

9. The electrical connector of claim 8 wherein the closure wall tapers inwardly along a direction from the entrance opening to the exit opening.

10. The electrical connector of claim 1 wherein:
the electrical connector is a busbar connector;
the housing defines a second port including:
a second entrance opening;
a second exit opening; and
a second conductor passage extending between and communicating with the second entrance opening and the second exit opening, the conductor passage being adapted to receive a second conductor therethrough; and
a second flowable sealant disposed in the second conductor passage, the second sealant being adapted for insertion of the second conductor therethrough and to the conductor member such that the second sealant provides a seal about the inserted second conductor;
wherein the second sealant is positively pre-pressurized prior to insertion of the conductor into the second sealant.

11. A method for forming an electrical connector for use with a conductor, the method comprising:
providing a housing defining a port, the port including:
an entrance opening;
an exit opening; and a conductor passage extending between and communicating with the entrance and exit openings, the conductor passage being adapted to receive the conductor therethrough;

placing a conductor member in the housing;

placing a flowable sealant in the conductor passage, the sealant being adapted for insertion of the conductor therethrough and to the conductor member such that the sealant provides a seal about the inserted conductor; and positively pre-pressurizing the sealant in the conductor passage such that the sealant is positively pre-pressurized prior to insertion of the conductor into the sealant.

12. The method of claim 11 wherein positively pre-pressurizing the sealant in the conductor passage includes:

forcing a compression member into the conductor passage to displace the sealant; and retaining the compression member in a position to maintain a load against the sealant.

13. The method of claim 11 wherein positively pre-pressurizing the sealant in the conductor passage includes positively pre-pressurizing the sealant in the conductor passage to an internal pressure of at least 0.5 PSI.

14. The method of claim 11 wherein the sealant is a gel and including elastically pre-elongating the gel in the conductor passage prior to insertion of the conductor into the gel.

15. The method of claim 14 including elastically pre-elongating the gel in the conductor passage by at least 5% prior to insertion of the conductor into the gel.

16. The method of claim 11 wherein the housing includes a penetrable closure wall extending across the conductor passage, and positively pre-pressurizing the sealant in the conductor passage includes loading the sealant against the closure wall prior to insertion of the conductor into the sealant.

17. A method for forming an electrical connection with a conductor, the method comprising:

providing an electrical connector including:

a housing defining a port, the port including:

an entrance opening;

an exit opening; and a conductor passage extending between and communicating with the entrance and exit openings, the conductor passage being adapted to receive the conductor therethrough;

a conductor member disposed in the housing; and a flowable sealant disposed in the conductor passage, the sealant being adapted for insertion of the conductor therethrough and to the conductor member such that the sealant provides a seal about the inserted conductor;

inserting the conductor through the conductor passage and the sealant disposed therein such that the sealant provides a pressurized seal about the conductor;

wherein the sealant is positively pre-pressurized prior to inserting the conductor through the sealant.

18. The electrical connector of claim 1 wherein the sealant is compressively pre-loaded such that the sealant has an elevated, positive internal pressure without the conductor being disposed in the sealant.

19. The method of claim 11 wherein positively pre-pressurizing the sealant includes compressively pre-loading the sealant such that the sealant has an elevated, positive internal pressure without the conductor being disposed in the sealant.

20. The method of claim 17 wherein:

the sealant is compressively pre-loaded such that the sealant has an elevated, positive internal pressure without the conductor being disposed in the sealant; and inserting the conductor through the conductor passage and the sealant includes inserting the conductor through the conductor passage and the sealant while the sealant has the elevated, positive internal pressure.

* * * * *